US005398906A

United States Patent [19]

Aydelott

[11] Patent Number: 5,398,906

[45] Date of Patent: Mar. 21, 1995

[54] WALL-MARKING DEVICE

[76] Inventor: Richard M. Aydelott, 1600 SE. 140th Ct., Vancouver, Wash. 98684

[21] Appl. No.: 936,862

[22] Filed: Aug. 26, 1992

Related U.S. Application Data

[63] Continuation-in-part of Ser. No. 876,970, May 1, 1992, abandoned.

[51] Int. Cl.[6] ..... F16M 13/00

[52] U.S. Cl. ..... 248/547; 248/477

[58] Field of Search ..... 248/544, 496, 497, 498, 248/546, 547, 495, 489; 33/613, 574, 666, 577, 520

[56] References Cited

U.S. PATENT DOCUMENTS

| | | | |
|---|---|---|---|
| 1,400,150 | 12/1921 | Goble | 248/544 |
| 3,031,159 | 4/1962 | Waller | 248/544 X |
| 3,516,165 | 6/1970 | Pfeffer | 33/520 X |
| 4,220,309 | 2/1980 | Eisen et al. | 248/542 |
| 4,382,337 | 5/1983 | Bendick | 33/613 X |
| 4,455,756 | 6/1984 | Greene | 248/547 X |
| 4,837,942 | 6/1989 | Watts | 33/574 X |
| 4,893,776 | 1/1990 | Floyd | 248/475.1 |
| 5,109,611 | 5/1992 | Houck | 33/613 |
| 5,129,154 | 7/1992 | Aydelott | 33/577 X |
| 5,180,135 | 1/1993 | Hindall | 248/544 |

*Primary Examiner*—Karen J. Chotkowski

*Attorney, Agent, or Firm*—Chernoff, Vilhauer, McClung & Stenzel

[57] ABSTRACT

A device for marking a wall to indicate where to install a support element such as a nail for hanging an article such as a picture. The device is self-supporting in relation to the article and is releasably attachable to the suspension element on the article. A preferred embodiment is attachable to a saw-tooth type bracket suspension element. A second embodiment of the wall-marking device is attachable to pictures equipped with wire or cord for hanging. A third embodiment is usable with either saw-tooth type bracket or wire suspension elements.

5 Claims, 6 Drawing Sheets

WALL-MARKING DEVICE

This application is a continuation-in-part of application Ser. No. 07/876,970, filed May 1, 1992, and now abandoned.

BACKGROUND OF THE INVENTION

The present invention relates to a wall-marking device and more particularly to a device for marking on a wall the desired location for the installation of a support for a hanging article such as a picture.

Pictures, mirrors, and similar articles intended for display and decoration on a wall are generally equipped with some means for suspending the article from a support element such as nail or hanger that is mounted or installed on the wall. Pictures, for example, are commonly equipped with a wire or cord that is attached at opposite sides of the picture frame, or with a saw-tooth type bracket that is attached at the back of the top of the picture frame, by means of which the picture can be suspended from the wall-mounted nail.

The means for suspending the picture, whether the suspension element is a wire, a saw-tooth type bracket, or other similar means, is located at the back of the picture and is out of sight when the placement of the picture is considered. It is therefore difficult to determine precisely where to install the nail or other support element so that once the picture is suspended from the nail it is exactly positioned at the desired location. The least desirable way to determine the placement of the nail is by trial-and-error. The person hanging the picture may be forced to settle for a location that is deemed "close enough" to the desired location or be left with unsightly, extra holes made in the wall before the precise nail-mounting location is identified.

Various devices have been disclosed as aids for locating the desired position for mounting the picture-supporting nail or similar support element. Floyd, U.S. Pat. No. 4,893,776, discloses a picture-hanging apparatus for marking the location at which a hanger for supporting the picture may be attached to a wall. The device includes a retracted wall-marking element that is pushed from its retracted position by means of a plunger-activated spring to mark a wall at the desired location.

Aydelott, in patent application Ser. No. 07/805,588, discloses a wall-marking device that includes a rigid handle interconnected by a pivoting assembly to the upper end of a rigid support from which the picture is suspended and including the wall-marking element.

The devices disclosed by Aydelott and Floyd support the picture while the site for the location of the picture hanger is selected. The entire weight of the picture is borne by the device, so the device must be tightly gripped and carefully moved to prevent the device from slipping from the hand and to prevent the accidental displacement of the picture from the device.

Eisen, et al., U.S. Pat. No. 4,220,309 discloses a picture hanging aid which is adhesively attached, first to the back of the picture and then to the wall. After removing the picture from the device, the desired location is marked with reference to the device as it adheres to the wall. Although the device is not required to support the weight of the picture, the adhesive employed by the device may damage the picture or the wall during its application to and removal from wall and picture. In addition, the adhesive is only effective for a single application, and if the device is inadvertently misapplied, it cannot be reused.

What is still needed is a simple, reusable device which is attachable to a picture in such a way it is not required to support the weight of the picture during its use in determining the proper placement of a nail or hanger for eventual support of the picture in the desired location. Such a wall-marking device, attachable to the picture, would preferably be self-supporting after attachment to the picture.

SUMMARY OF THE INVENTION

The present invention provides a wall-marking device that can be used to locate the desired position for installing an article-hanging support element on a wall so that when a suspension element on the article is suspended from the support element the article will be positioned at the desired location on the wall. The wall-marking device includes a body having elements for attachment to the article, at the article-suspension element, in a self-supporting manner, and a wall-marking element projecting transversely from the body.

In a first embodiment, the body is flexible and includes an upwardly-projecting triangularly-shaped projection and a downwardly-projecting book that cooperatively engage a saw-tooth type bracket. A wall-marking element is located at the rear of the body.

In a second embodiment of the invention, a spring is located within the body of the wall-marking device. By compressing the spring, the position of an angular projection, arranged to engage the suspension element, is adjusted relative to an element projecting from the top of the body and over the top of the article being hung to permit attachment of the device to a suspension element. This embodiment of the device is attachable to picture frames equipped with either a saw-tooth type bracket or a wire for suspending the picture. A wall-marking element projecting from the rear of the device is usable to mark a desired location on a wall.

A third embodiment of the invention includes a spring located within the body of the wall-marking device and a plunger for compressing the spring as desired. The plunger includes an angular projection that is adjustable in relation to a projection projecting from the top front of the body for attachment of the body of the device to a saw-tooth type bracket. Again, a rear-projecting wall-marking element is used for marking a wall.

It is a principal object of the present invention to provide a wall-marking device which is readily attachable to a picture, yet which need not support the weight of the picture, while the desired location for the picture-hanging support element is selected and marked on a wall.

It is a further object of the invention to provide a wall-marking device which can be used to mark the location where a picture-hanging support element can be installed when the picture is equipped with either a wire or cord or a saw-tooth type bracket for hanging.

It is also an object of the invention to provide a wall-marking device that is reusable.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
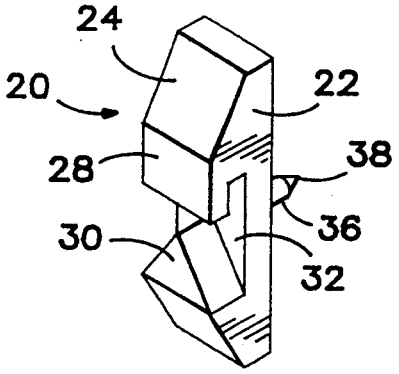
FIG. 1 is a perspective view of a wall-marking device embodying the present invention and attachable to a saw-tooth type bracket of a picture frame.
Figure 2:
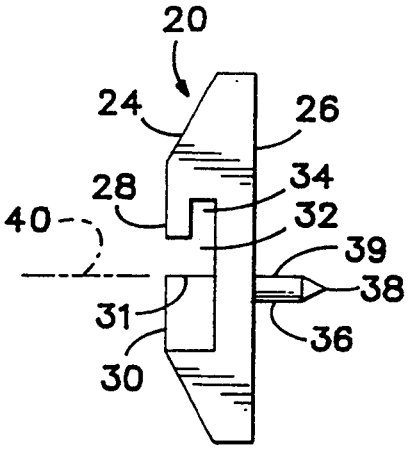
FIG. 2 is a side elevational view of the wall-marking device shown in FIG. 1.
Figure 3:
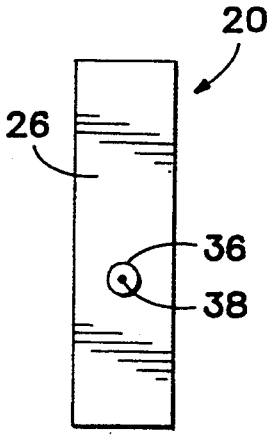
FIG. 3 is rear elevational view of the wall-marking device shown in FIG. 1.

A preferred embodiment of a wall-marking device 20 embodying the present invention is shown in FIGS. 1–4. The body 22 of the wall-marking device 20 includes a front portion 24 and a rear portion 26. The front portion of the body includes a downwardly-projecting hook 28 and an upwardly-projecting triangularly-shaped projection 30 which together define an opening 32. A recess portion 34 of the opening 32 is located directly behind the hook portion 28. A wall-marking member 36 having a sharp tip 38 projects from the generally flat rear portion 26 of the body. The wall-marking member is located so that the apex 31 of the triangularly-shaped projection 30 and the top 39 of the wall-marking member generally lie along a straight line 40.

Figure 4:
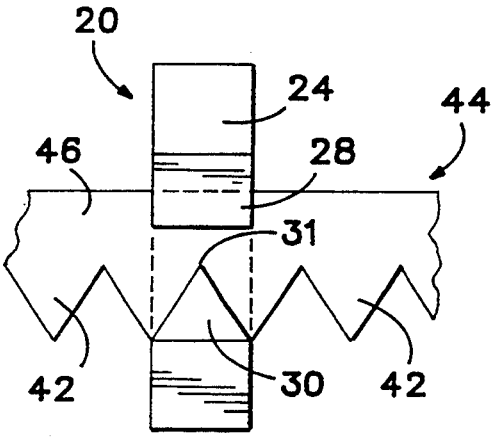
FIG. 4 is a fragmentary front elevational view of the device shown in FIG. 1 engaging a picture frame's saw-tooth type bracket.
Figure 5:
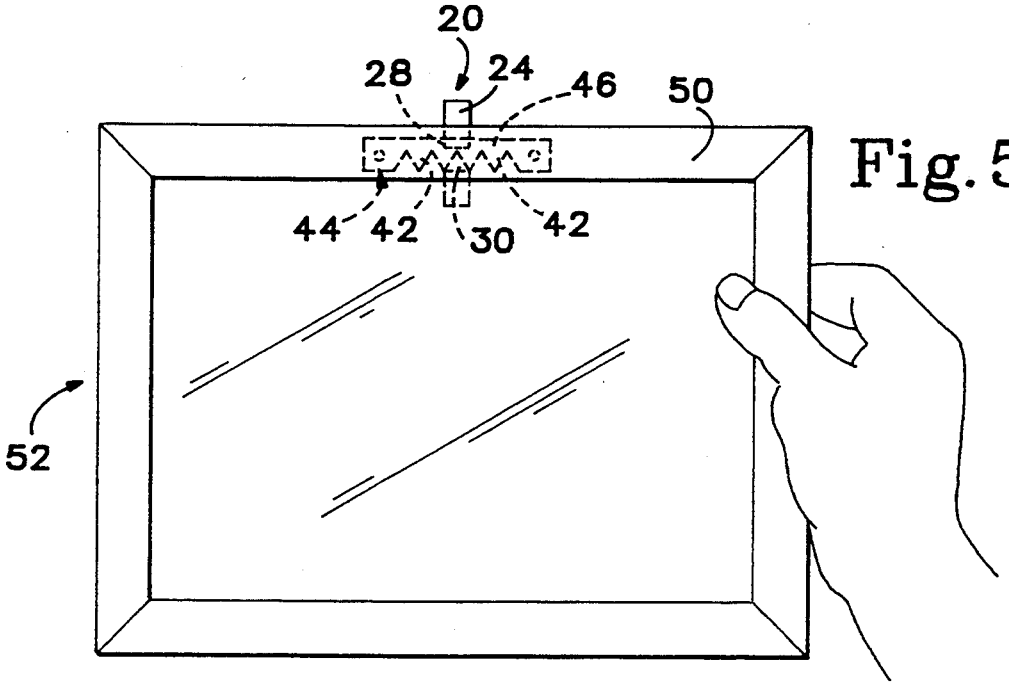
FIG. 5 is a partially schematic front elevational view of a hand holding a picture frame with the device shown in FIG. 1 attached to the saw-tooth type bracket of the frame.
Figure 6:
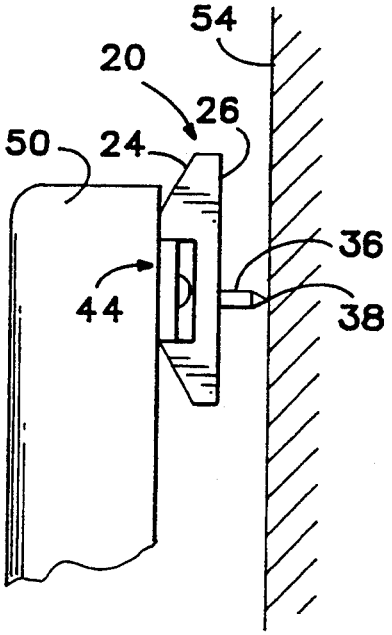
FIG. 6 is a fragmentary side elevational view of the device shown in FIG. 5 in position for marking a location on a wall.
Figure 7:
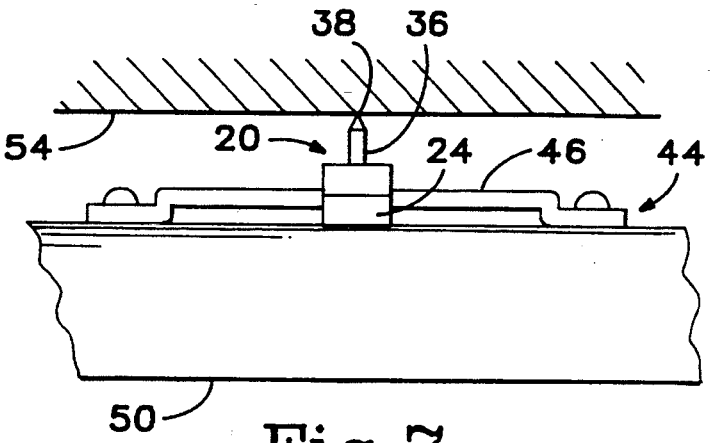
FIG. 7 is a fragmentary top plan view of the device shown in FIG. 6.
Figure 8:
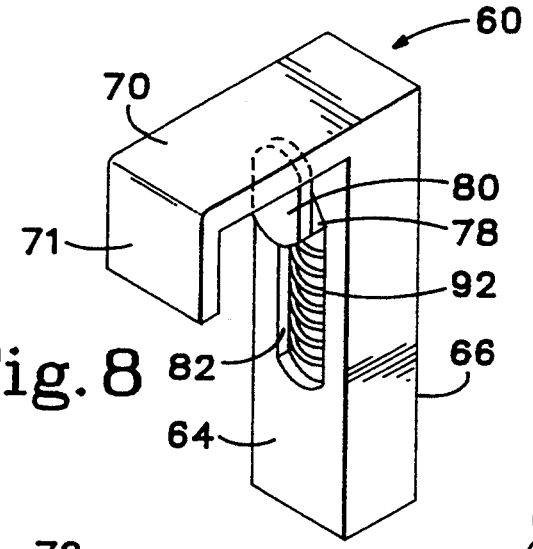
FIG. 8 is a perspective view of an alternative embodiment of the wall-marking device of the present invention.
Figure 9:
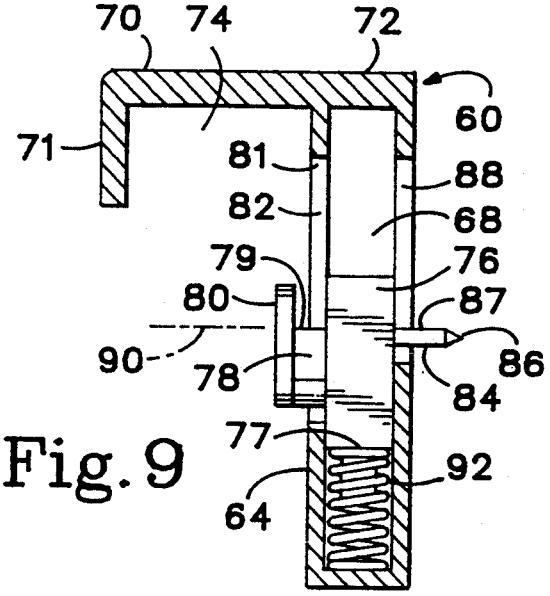
FIG. 9 is a side elevational view of the device shown in FIG. 8 with a compressed spring and a portion of the body of the device cut away.
Figure 10:
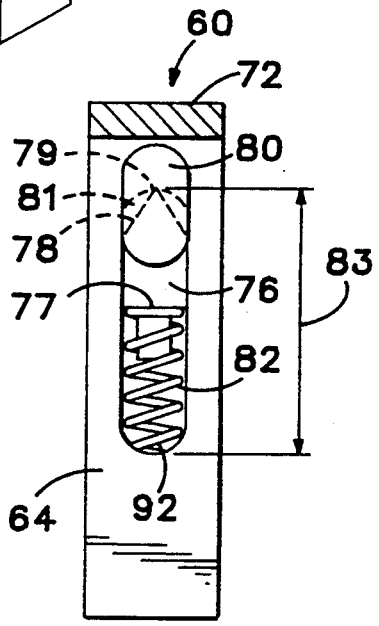
FIG. 10 is a front elevational view of the device shown in FIG. 8 with a portion of the front of the device cut away.
Figure 11:
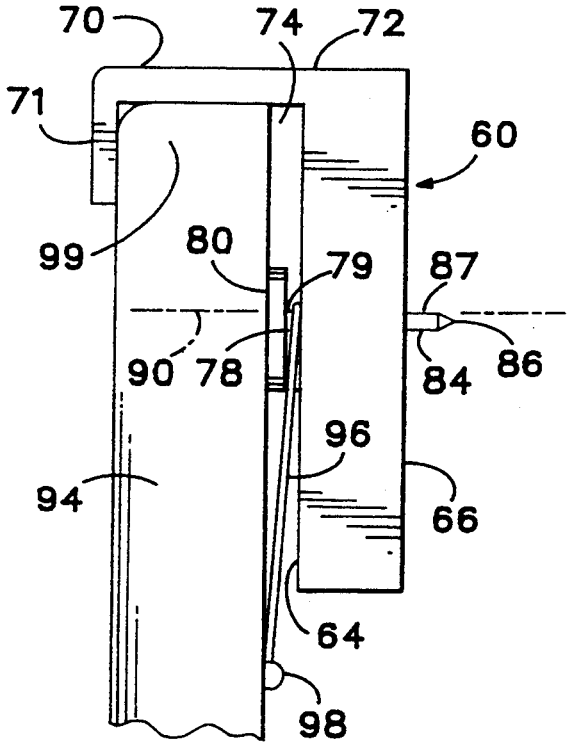
FIG. 11 is a fragmentary side elevational view of a picture frame equipped with a wire for hanging with the device shown in FIG. 8 attached in preparation for marking a location on a wall.
Figure 12:
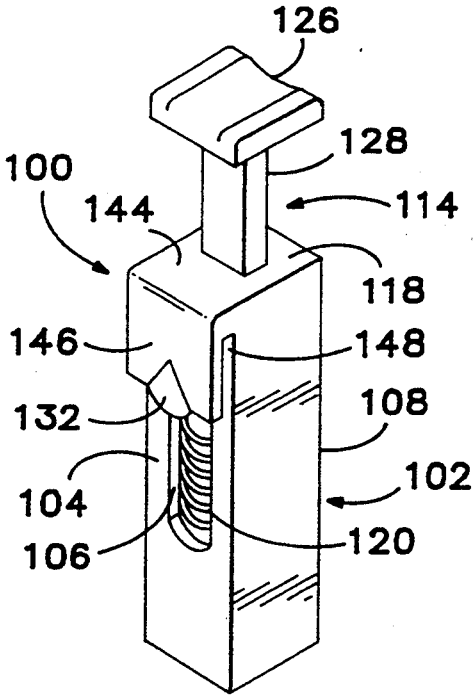
FIG. 12 is a perspective view of another embodiment of the wall-marking device of the present invention.
Figure 13:
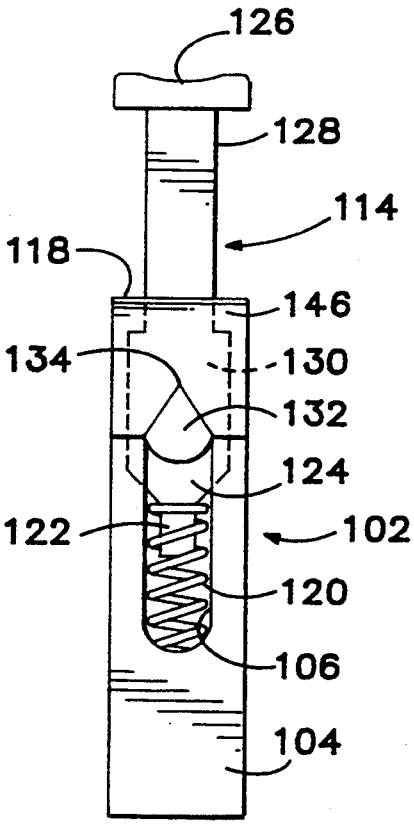
FIG. 13 is a front elevational view of the device shown in FIG. 12 with a portion of the interior of the body shown in phantom.

The wall-marking device 20 engages a saw-tooth type bracket 44 that is attached to a picture frame for use in hanging the picture on a wall, as shown in FIGS. 4–7. The hook 28 fits partially over bracket 44 to receive the top 46 of the bracket in the recess portion 34 of the opening 32, and the triangularly-shaped projection member 30 fits between two of the teeth 42 on the bracket 44, as best shown in FIG. 4. The body 22 of the device is preferably made of a material which imparts enough flexibility, such as a synthetic rubber-like material, to insure the ability of the front portions of the body of the device to engage the saw-tooth type bracket.

As shown in FIGS. 4–7, when the device engages the bracket the device becomes self-supporting and both hands of the person hanging the picture are free to hold the picture 52 while determining the desired location for hanging the picture. The picture, with the wall-marking device attached, is held adjacent to the wall 54 and the exact location where the picture is desired to be hung is determined. When the desired wall position is located, pressure exerted on the picture frame 50 is translated from the frame to the device and the wall-marking member 36, forcing the tip 38 of the wall-marking member against the wall.

The wall-marking member is typically an elongate, rigid projection with a sharpened tip which marks a small depression in the wall at the desired location, but the tip can also be adapted to mark the wall with graphite, ink, or a similar pigmented-type marking material. A nail or similar picture-supporting element installed in the wall at the location marked by the device will suspend the picture at the desired location.

The wall-marking device 60, shown in FIGS. 8–11, is an alternative embodiment of the present invention. The body 62 of the device 60 defines a front portion 64, a rear portion 66, and an interior cavity 68. A bracket arm 70 projects from the top 72 of the body and includes a downwardly-projecting extension portion 71 generally parallel with the front part of the body, defining a bracket arm opening 74.

A support block 76 is slidably disposed within the cavity 68. The support block carries a generally triangularly-shaped projection 78 that extends through an opening 82 defined in the front portion 64 of the body, and a wall-marking element 84 that extends through an opening 88 defined in the rear portion 66 of the body. Attached to the triangularly-shaped projection 78 is an end piece 80. The apex 79 of the triangularly-shaped projection 78 and the top 87 of the wall-marking element 84 generally lie along a straight line 90.

The bottom 77 of the support block contacts a spring 92, or similar biasing element, located within the cavity portion of the body. By compressing the spring the position of the support block can be adjusted along the length 83 of the opening 82. When the spring is uncompressed the end piece 80 approaches the bracket arm 70 and the apex 79 of the triangularly-shaped projection is adjacent the end 81 of the opening 82. The spring is compressed as necessary to enable the triangularly-shaped projection 78 and the end piece 80 to engage the suspension element on a picture which is to be wall-mounted.

When the picture frame 94 includes a wire 96 or cord, generally attached at opposite sides of the frame by means of an eyelet 98 or similar attachment, the top 99 of the frame is inserted into the bracket arm opening 74. The spring 92 is compressed to the extent necessary to insert the picture wire 96 behind the end piece 80 and over the triangularly-shaped projection 78. The wall-marking device 60 is thus attached to the picture, with the picture-hanging wire 96 remaining taut due to the tensioning action of the spring 92. The wall-marking device is self-supporting as the picture is held in proximity to the wall. When the location for inserting a nail in the wall for supporting the picture as desired has been determined, pressure is exerted on the frame 94 or the extension portion 71 of the bracket arm sufficient to force the tip 86 of the wall-marking element to mark the wall. A nail or other support element is then installed in the wall at the marked location.

It will be apparent that the wall-marking device 60 can also be used when the picture frame is equipped with a saw-tooth type bracket in a manner similar to that described for the wall-marking device 20. The top of the frame is inserted in the bracket arm opening to rest against the bracket arm. The spring is compressed sufficient to permit the end piece 80 to pass behind the bracket and to permit the triangularly-shaped projection 78 to engage the teeth of the bracket. The device 60 remains attached to the frame and bracket, leaving both hands of the picture hanger to support the picture.

The wall-marking device 100, shown in FIGS. 12–16, is another embodiment of the present invention. The body 102 of the device 100 defines a front portion 104 including an opening 106, a rear portion 108 including an opening 110, and an internal cavity 112. A plunger 114 enters the cavity 112 through an opening 116 in the top 118 of the body. A spring 120, which is located within the cavity, receives a reduced diameter bottom portion 122 of the plunger and contacts a shoulder 124. A plunger cap 126 is attached to the top portion 128 of the plunger.

The medial portion 130 of the plunger supports a generally triangularly-shaped projection 132 that projects through the front opening 106 in the body, and a wall-marking element 136 that projects through the rear opening 110 in the body. The apex 134 of the triangularly-shaped projection and the top 140 of the wall-marking element generally lie along a straight line 142.

An arm 144 projects from the top of the body and terminates in a bracket 146, located generally parallel to the front portion of the body, to define a bracket arm opening 148 between the bracket 146 and the front portion of the body 104. A notch 150 in the bracket 146 is located to receive a portion of the triangularly-shaped projection 132 when the spring 120 is not compressed.

Figure 14:
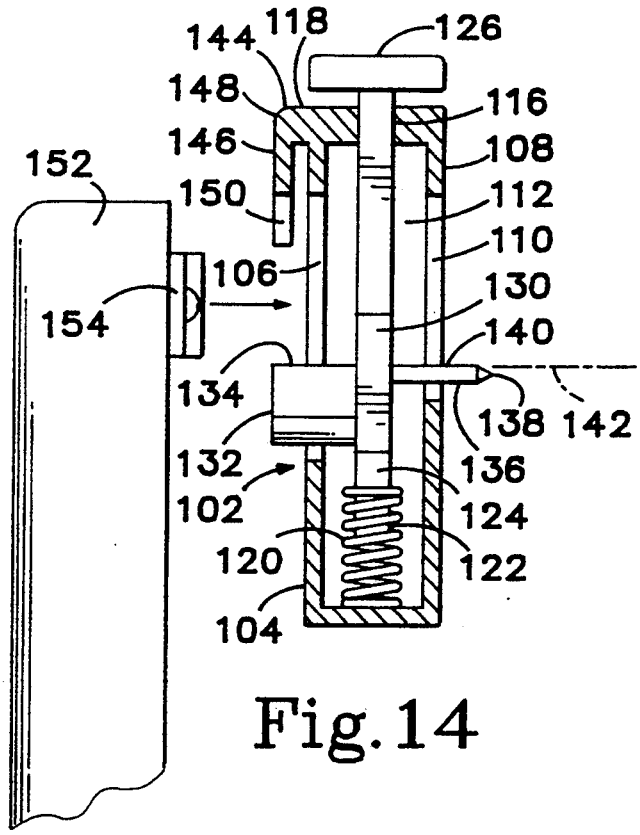
FIG. 14 is a side elevational view of the device shown in FIG. 12 with spring compressed in preparation to receive the saw-tooth type bracket on a picture frame and with a portion of the body of the device cut away.
Figure 15:
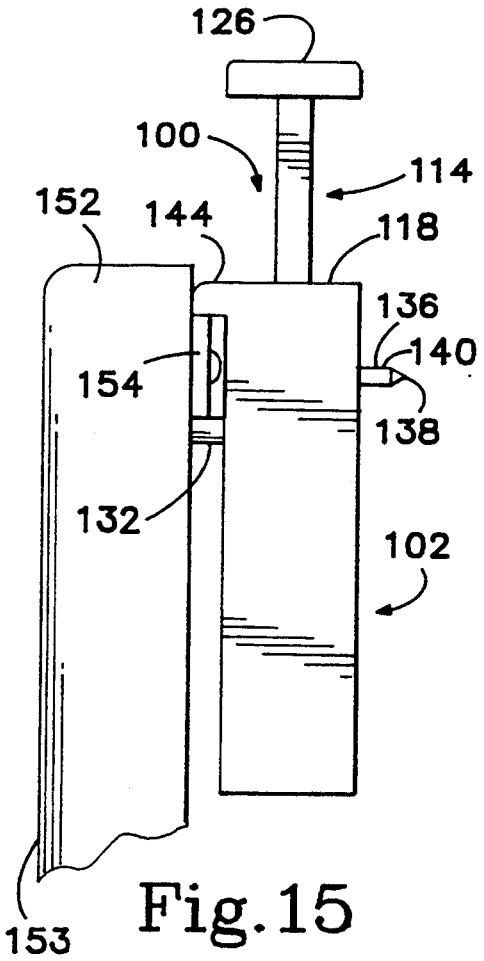
FIG. 15 is a side elevational view of a portion of a picture frame with the device shown in FIG. 12 attached to a saw-tooth type bracket in preparation for marking a wall.
Figure 16:
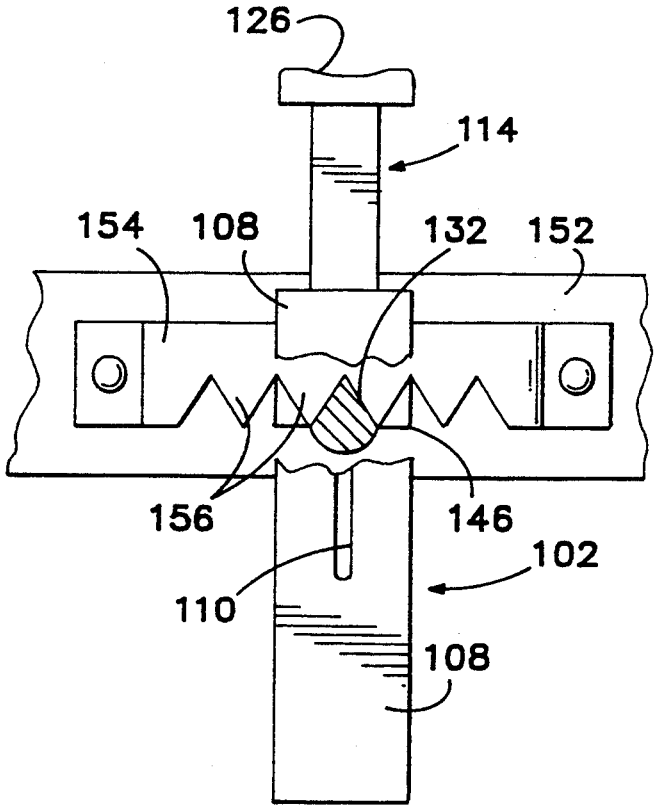
FIG. 16 is a fragmentary rear elevational view of the device shown in FIG. 15 with a portion of the device cut away.

As best seen in FIGS. 14–16, the wall-marking device 100 is attachable to a picture frame 152 having a saw-tooth type bracket 154. Pressure on the plunger cap 126 depresses the plunger 114 and compresses the spring 120. As the spring is compressed, the triangularly-shaped projection 132 moves away from the notch 150. The bracket 146 is inserted behind the saw-tooth type bracket 154 on the picture frame, and the saw-tooth type bracket enters the bracket arm opening 148. As the pressure on the plunger cap 126 is relieved, the triangularly-shaped projection 132 moves toward the notch 150 until the apex 134 of the triangularly-shaped projection engages the teeth 156 of the saw-tooth type bracket 154 on the picture frame and the tension of the spring maintains the position.

With the wall-marking device 100 attached to the picture frame 152 the desired location for hanging the picture can be determined. Pressure is applied to the front of the frame 153 to cause the tip 138 of the wall-marking element 136 to mark the wall at the location where a nail is to be installed to permit hanging the picture in the desired location.

Figure 17:
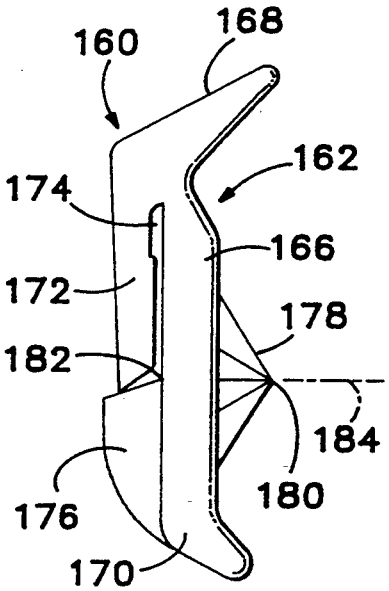
FIG. 17 is a side elevational view of yet another embodiment of the present invention.
Figure 18:
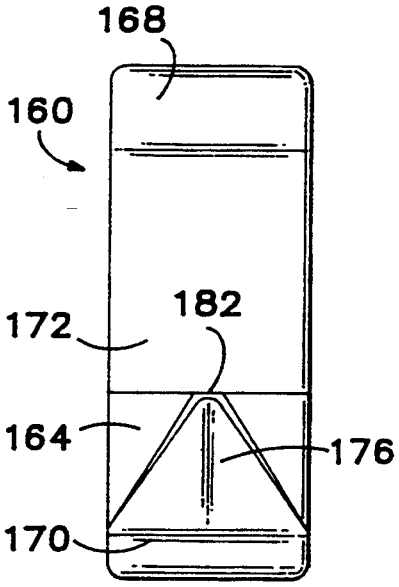
FIG. 18 is a front elevational view of the device of FIG. 17.
Figure 19:
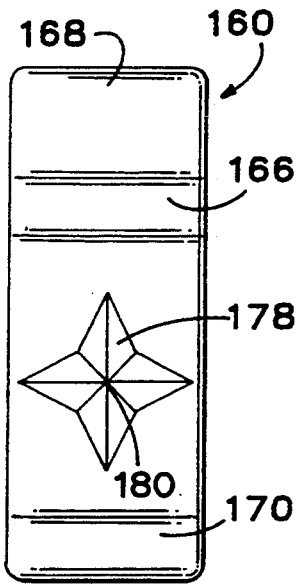
FIG. 19 is a rear elevational view of the device of FIG. 17.

The wall-marking device 160 shown in FIGS. 17–19 is an alternate embodiment of the present invention. The body 162 of the device defines a front section 164, a rear section 166, a top 168 and a bottom 170. The front section 164 includes an elongate portion 172 projecting from the top 168 of the body and defining an elongate slot 174, and an angular projection 176 projecting from the bottom 170 of the body. The rear section of the body includes a wall-marking element 178 having a wall-marking tip 180. The apex 182 of the angular projection portion 176 and the wall-marking tip 180 of the wall-marking element generally lie along a straight line 184. The wall-marking device 160, which is preferably formed of a flexible material, is attachable to a picture frame having a saw-tooth type bracket by inserting the elongate portion 172 behind the saw-tooth type bracket, the elongate slot receiving a portion of the saw-tooth type bracket, as the apex 182 of the angular projection engages the teeth of the saw-tooth type bracket. The wall-marking device 160 is then usable to mark a location on a wall in a manner similar to that previously described.

Figure 20:
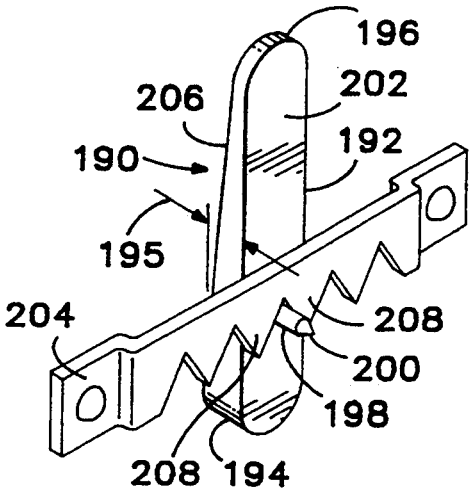
FIG. 20 is a perspective view of an alternative embodiment of the wall-marking device shown in relation to a saw-tooth type bracket.
Figure 21:
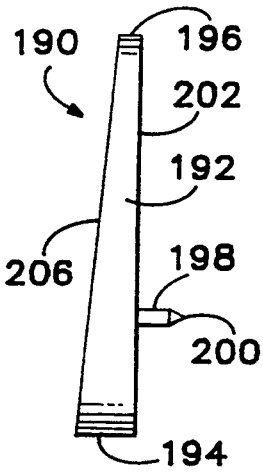
FIG. 21 is a side elevational view of the wall-marking device shown in FIG. 20.
Figure 22:
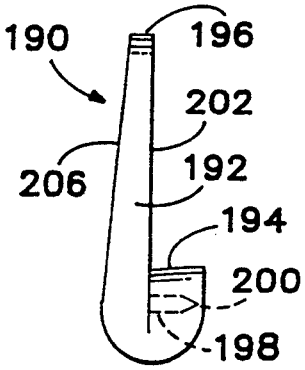
FIG. 22 is a side elevational view of the wall-marking device of FIG. 21 shown folded over on itself.

An additional embodiment of the present invention is shown in FIGS. 20–22. The wall-marking device 190 is preferably made of a deformable elastomeric material such as foam rubber. The body 192 of the device is wedge-shaped, having a wider base 194, and a narrower top 196. A wall-marking member 198 having a sharp tip 200 projects from one generally planar face 202 of the body. The wedge-shaped body 192 has a width 195 proximate the wall-marking member that is about the same as the distance between a saw-tooth bracket and a frame. As shown in FIG. 20, the device 190 is attached to a picture at the saw-tooth bracket 204 by inserting the top 196 of the device between the frame (not shown) and the bracket 204, with the second generally planar face 206 contacting the frame, and sliding the device up to engage the wall-marking member 198 between two bracket teeth 208. Because of its shape and deformability, the device remains wedged in place while the desired wall position is located and marked for later installation of a support element as previously described. As shown in FIG. 22, the device 190 can be folded to cover and protect the sharp tip 200 of the wall-marking member for storage or generally when the device is not in use.

Figure 23:
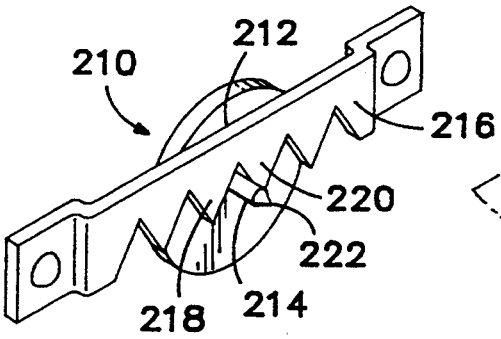
FIG. 23 is a perspective view of an alternative embodiment of the wall-marking device shown in relation to a saw-tooth type bracket.

The wall-marking device 210, shown in FIG. 23, is made of a magnetic material, and may be of any convenient shape. The body 212 of the device, from which a wall-marking member 214 projects, attaches to any suspension element that contains a ferro-magnetic material, such as a saw-tooth type bracket 216. The device is inserted between the bracket and its frame and is magnetically attached to the bracket so that the wall-marking member is located between two bracket teeth 218 and 220. The magnetic forces keep the device in place while the tip 222 of the wall-marking member marks the desired location for locating the picture.

Figure 24:
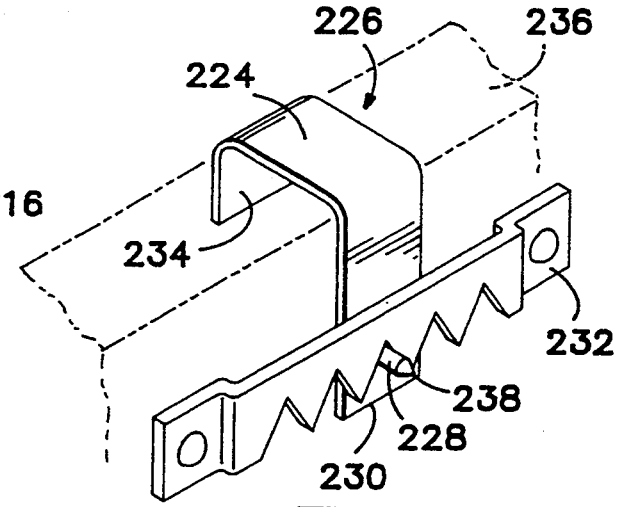
FIG. 24 is a perspective view of an alternative embodiment of the wall-marking device shown in relation to a saw-tooth type bracket.

As shown in FIG. 24, the body 224 of another wall-marking device 226 is formed of a malleable material such as a metal or metal alloy, in a strip, as shown, or other convenient shape such as a wire. A wall-marking member 228 projects from one end 230 of the generally elongate body 224. The wall-marking member engages a saw-tooth type bracket 232, as shown in FIG. 24, or other suspension element of the picture. The body 224 of the device is manipulated as desired, for example to form a bracket or hook shape, as the second end 234 of the body engages the frame 236 and retains the wall-marking member in position as the user marks a position on a wall by forcing the tip 238 of the wall-marking member against the wall.

Figure 25:
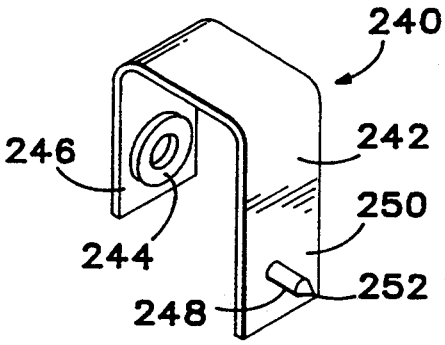
FIG. 25 is a perspective view of an alternative embodiment of the wall-marking device of the present invention.

In another alternative embodiment to the present invention shown in FIG. 25, the wall-marking device 240 has an elongate body 242 made of a flexible woven or nonwoven material such as cloth fabric. A weight 244 is attached to one end 246 of the body, and a wall-marking member 248 projects from the second end 250. The wall-marking member engages the suspension element of the picture while the second end of the device extends over the top of the frame, with the weight holding the device in place until the desired picture placement is determined. The location is marked by pressing on the picture frame and forcing the tip 252 of the wall-marking member against the wall.

Figure 26:
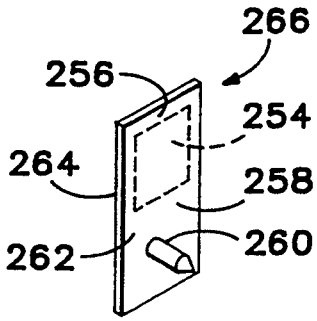
FIG. 26 is a perspective view of an alternative embodiment of the present invention.

Alternatively, as shown in FIG. 26, the weight is replaced with a piece of adhesive material 254 that is fastened to the second end 256 of the body 258. The wall-marking member 260 projects from a first side 262 of the body and the adhesive material is attached to the second side 264. The adhesive material attaches the wall-marking device 266 temporarily to the picture when the wall-marking member 260 engages the suspension element of the picture.

Figure 27:
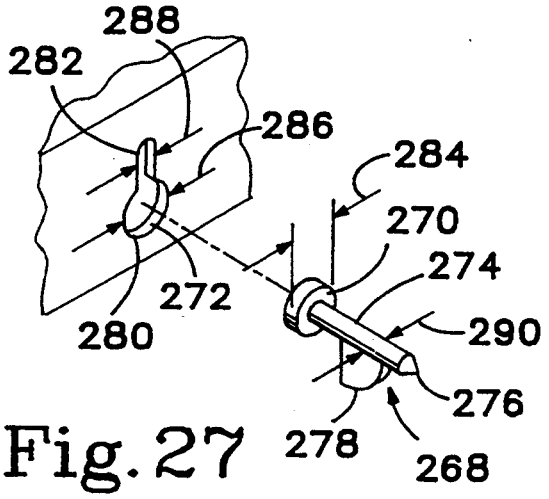
FIG. 27 is a perspective view of an alternative embodiment of the present invention shown with a portion of a picture having a precut aperture for receiving a support element.
Figure 28:
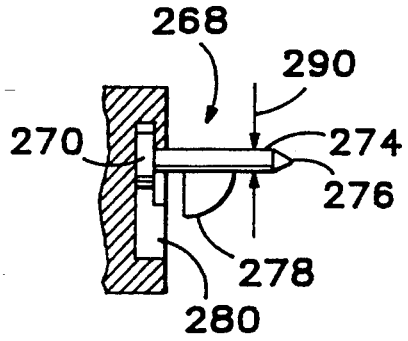
FIG. 28 is a side elevational view of the device of FIG. 27 shown attached to the precut aperture of a picture with a portion of the picture broken away.

The wall-marking device 268, shown in FIGS. 27 and 28, has a body 270 adapted for use with a suspension element in the form of a precut aperture 272. A wall-marking member 274 having a sharp tip 276 projects from the body and includes a finger grip 278. The body is inserted in the bottom 280 of the keyhole-shaped precut aperture and gently forced into the narrow upper portion 282 of the aperture. The diameter 284 of the body is smaller than the diameter 286 of the bottom of the key hole, but larger than the diameter 288 of the upper portion of the key hole. The diameter 290 of the wall-marking member is slightly wider than the diameter of the upper portion of the aperture so that the device remains in place while the desired location of the support element is determined and marked.

Figure 29:
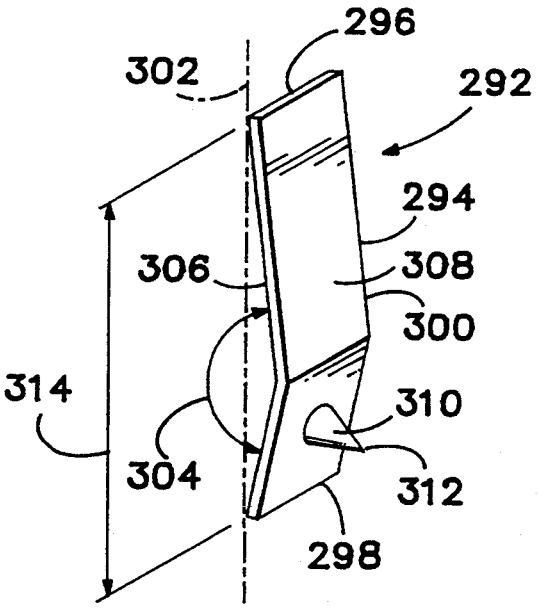
FIG. 29 is a perspective view of an alternative embodiment of the present invention.
Figure 30:
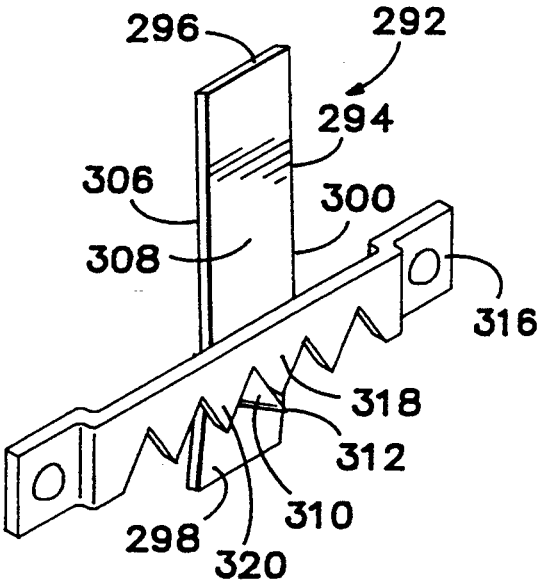
FIG. 30 is a perspective view of the wall-marking device of FIG. 29 shown in relation to a saw-tooth type bracket.

An additional embodiment of the present invention is shown in FIGS. 29–30. The wall-marking device 292 has a generally elongate body 294 having first 296 and second 298 ends and defining a medial section 300 therebetween. As best shown in FIG. 29, the ends of the body define generally a plane 302, while the medial section 300 of the body lies generally above or below the plane. The body thus forms an obtuse angle 304, thereby defining an obtuse side 306 and a non-obtuse side 308, opposite the obtuse side. A wall-marking member 310 having a sharp tip 312 projects at one end 298 of the device from the non-obtuse side 308 of the device. The body 294 of the device 292 is preferably made of the rigid material, for example, metal or a generally non-deformable polymeric material, so that pressure exerted on the non-obtuse side 308 of the body causes the obtuse angle 304 to increase and generally increases the distance 314 between the ends 296 and 298 of the body 294. When the pressure is removed, the obtuse angle returns generally to its original size.

As shown in FIG. 30, the device 292 is attached to a picture at the saw-tooth bracket 316 by inserting the end 296 of the device between the bracket and the frame (not shown) with the obtuse side 306 of the device proximate the frame. Pressure is exerted as necessary on the non-obtuse side 308 of the device to increase the size of the obtuse angle sufficient to engage the wall-marking member 310 between two bracket teeth 318 and 320. Because of its tendency to return to its original shape, the device remains in place between the frame and the bracket 316 as the tip 312 of the wall-marking member 310 is pushed against a wall to mark the desired location for the installation of the support element. The device 292 is similarly attached to a frame (not shown) defining saw teeth as an integral part of the frame. It will also be appreciated that although the body of the device shown in FIG. 29 defines an obtuse angle, the body could alternatively have an arc thereby defining convex and concave sides and having a wall-marking member projecting from the convex side.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for marking the location on a wall where a support element that supports a hanging article will be mounted so that when a suspension element on the article is suspended from the support element the article will be positioned at the desired location on the wall, said device comprising:

(a) a body defining engagement means for releasably engaging the suspension element with said body being self-supported on the article by said engagement means when said engagement means is engaging the suspension element; and (b) wall-marking means projecting transversely from said body for marking the wall at the location where a support element would be installed in order to support the element at the desired location when said engagement means is engaging the suspension element and pressure is applied to the front of the article;

(c) said suspension element including a saw-tooth engagement surface, said body being generally elongate, having first and second ends and a medial section therebetween, said first and second ends defining generally a plane and at least a portion of said medial section lying generally outside said plane, said wall-marking means projecting generally from one of said ends;

(d) said medial section defining an obtuse angle, said medial section having an obtuse side and a side opposite said obtuse side, said wall-marking means projecting generally from said side opposite said obtuse side.

2. A device for marking the location on a wall where a support element that supports a hanging article will be mounted so that when a suspension element on the article is suspended from the support element the article Will be positioned at the desired location on the wall, said device comprising:

(a) a body defining engagement means for releasably engaging the suspension element with said body being self-supported on the article by said engagement means when said engagement means is engaging the suspension element; and (b) wall-marking means projecting transversely from said body for marking the wall at the location where a support element would be installed in order to support the element at the desired location when said engagement means is engaging the suspension element and pressure is applied to the front of the article;

(c) said suspension element being a rigid elongate picture hanging bracket having a saw-tooth engagement surface, and said body including a pair of spaced apart planar surfaces which are angled with respect to one another, said surfaces having a point of minimum separation at one end of said boy which is less than the distance between said bracket and said article and a point of maximum separation at another end of said body which is greater than the distance between said bracket and said article.

3. The device of claim 2 wherein said body is a deformable elastomeric material.

4. The device of claim 3 wherein said projection is projecting medially from one of said planar surfaces at a location where the separation between said planar surfaces is slightly greater than the distance between said bracket and said article.

5. A device for marking the location on a wall where a support element that supports a hanging article will be mounted so that when a suspension element on the article is suspended from the support element the article Will be positioned at the desired location on the wall, said device comprising:

(a) a body defining engagement means for releasably engaging the suspension element with said body being self-supported on the article by said engagement means when said engagement means is engaging the suspension element; and (b) wall-marking means projecting transversely from said body for marking the wall at the location where a support element would be installed in order to support the element at the desired location when said engagement means is engaging the suspension element and pressure is applied to the front of the article;

(c) said suspension element being a rigid picture hanging bracket having a saw-tooth engagement surface, and said body comprising an elongate strip having opposed ends which define a plane and a medial section which is separated from said plane by a distance which is greater than the distance between said bracket and said article, said strip being of a bendable material so that the separation between said medial section and said plane is decreased when pressure is applied to said medial section and increases when said pressure is removed.

* * * * *

UNITED STATES PATENT AND TRADEMARK OFFICE

CERTIFICATE OF CORRECTION

PATENT NO. : 5,398,906

DATED : March 21, 1995

INVENTOR(S) : Richard M. Aydelott

It is certified that error appears in the above–identified patent and that said Letters Patent are hereby corrected as shown below:

Column 10, Line 4: delete "boy" insert
-- body --

Signed and Sealed this

Thirteenth Day of June, 1995

*Attest:*

Bruce Lehman

BRUCE LEHMAN

*Attesting Officer*

*Commissioner of Patents and Trademarks*